US010299573B2

(12) United States Patent
Swims et al.

(10) Patent No.: US 10,299,573 B2
(45) Date of Patent: May 28, 2019

(54) CLASP FOR SECURING PERSONAL ITEM

(71) Applicant: Jack & Izzy, LLC, Atlanta, GA (US)

(72) Inventors: Teresa Kane Swims, Atlanta, GA (US); Meredith Van Houten, Atlanta, GA (US); Anne Sherryll Windsor, Roswell, GA (US)

(73) Assignee: Jack & Izzy, LLC, Atlanta, GA (US)

( * ) Notice: Subject to any disclaimer, the term of this patent is extended or adjusted under 35 U.S.C. 154(b) by 193 days.

(21) Appl. No.: 15/270,814

(22) Filed: Sep. 20, 2016

(65) Prior Publication Data

US 2018/0078022 A1 Mar. 22, 2018

(51) Int. Cl.
*A45F 5/00* (2006.01)

(52) U.S. Cl.
CPC ..... *A45F 5/00* (2013.01); *A45F 2005/006* (2013.01); *A45F 2200/0541* (2013.01)

(58) Field of Classification Search
CPC ..... A45F 5/00; A45F 2005/006; A45F 2200/0541
See application file for complete search history.

(56) References Cited

U.S. PATENT DOCUMENTS

| | | | | |
|---|---|---|---|---|
| 1,340,313 | A * | 5/1920 | Zipp | B66C 1/585 114/51 |
| 1,918,486 | A * | 7/1933 | Onos | B65D 71/50 294/118 |
| 2,442,698 | A | 6/1948 | Lang | |
| 3,352,589 | A * | 11/1967 | Kilboy | B65G 7/12 294/104 |
| 3,956,804 | A | 5/1976 | Gatof et al. | |
| 4,441,746 | A | 4/1984 | Corboy, Jr. | |
| 5,805,262 | A | 9/1998 | Deveney | |
| 5,860,191 | A | 1/1999 | Sieger | |
| 5,893,198 | A | 4/1999 | Decotis | |
| 6,533,414 | B2 | 3/2003 | Newler | |
| 6,598,268 | B1 | 7/2003 | Zelman | |
| 7,322,214 | B2 | 1/2008 | Ignatowski | |
| 7,721,392 | B2 | 5/2010 | Avery | |
| 7,850,302 | B1 | 12/2010 | Riazi | |
| 9,144,271 | B2 | 9/2015 | Tribelhorn | |
| 9,763,459 | B2 * | 9/2017 | Hazenbroek | A22C 21/0053 |
| 2005/0241115 | A1 | 11/2005 | Zoullas | |
| 2006/0248688 | A1 | 11/2006 | Vermillion | |
| 2010/0263170 | A1 | 10/2010 | Dollar, Sr. | |
| 2011/0277276 | A1 | 11/2011 | Pucci | |
| 2012/0184976 | A1 | 7/2012 | Nakamura | |
| 2016/0025996 | A1 | 1/2016 | Bacon | |
| 2016/0058137 | A1 | 3/2016 | Prestwidge | |

FOREIGN PATENT DOCUMENTS

| | | |
|---|---|---|
| JP | 3040251 | 8/1997 |
| KR | 101457458 | 11/2014 |

OTHER PUBLICATIONS

ISA/US, Int. Search Report and Written Opinion issued on PCT application No. US2017/050220, dated Nov. 16, 2017, 7 pgs.

* cited by examiner

*Primary Examiner* — Robert Sandy
*Assistant Examiner* — Louis A Mercado
(74) *Attorney, Agent, or Firm* — Greenberg Traurig, LLP

(57) ABSTRACT

A clasp device for securing relatively small personal items. The clasp is moveable between a default closed position and an open position, for respectively securing and releasing at least a portion of the personal item.

20 Claims, 14 Drawing Sheets

CLASP FOR SECURING PERSONAL ITEM

FIELD OF INVENTION

This disclosure relates generally to devices and systems for securing a personal item relatively close to a human body, and more specifically relates to clasps for holding a personal item, such as a pair of eyeglasses, a key, or a ring.

BACKGROUND OF THE INVENTION

Individuals wearing personal items, such as eyeglasses, rings and keys, may sometimes wish to remove and/or replace the items, and it is desirable to keep the items nearby, in order to be able to locate and replace them easily. For instance, eyeglasses may be reading glasses, sunglasses, or safety glasses, which are used only on certain occasions, and may otherwise be removed and temporarily kept close to the wearer, so that they are still easily accessible later. Conventionally, many wearers often place the items in a pocket or container, or hang them from an opening of a shirt or sweater. Those are usually not safe or convenient ways to secure the personal items.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

The disclosure provides a clasp device for securing relatively small personal items. The clasp is moveable between a default closed position and an open position, for respectively securing and releasing at least a portion of the personal item.

An aspect of the present invention is directed to a clasp for securing a personal item to a human wearer. The clasp includes a first member, a second member coupled with the first member at a first pivoting point, a third member coupled with the first member at a second pivoting point, and a fourth member coupled with the second member at a third pivoting point and coupled with the third member at a fourth pivoting point. The third and fourth members each have respective extensions that extend beyond the fourth pivoting point. The extensions of the third and fourth members are also movable between a default closed position and an open position relative to each other, for respectively securing and releasing at least a portion of the personal item.

Another aspect of the present invention is directed to a clasp for securing a personal item to a human wearer that includes a set of jaws that are movable between an open position and a closed position about a pivoting end of the jaws. The jaws are sized and shaped to securely hold the personal item when in the closed position. The clasp also includes a linkage coupled with the pivoting end of the jaws and configured to cause the jaws to move to the open position when manipulated in a first direction and to cause the jaws to move to the closed position when manipulated in a second direction.

The feature or features of one embodiment may be applied to other embodiments, even though not described or illustrated, unless expressly prohibited by this disclosure or the nature of the embodiments.

Details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Generally speaking, various embodiments of the present invention provide for a clasp, which may be attachable to a necklace or chain, shirt button or the like, for securing personal item(s). The personal items usually have relatively small sizes. Examples of the personal items include, but are not limited to, a pair of eyeglasses, a ring, and key(s). The default position of the clasp is the closed position. The clasp is moveable between the default closed position and an open position, for respectively securing and releasing at least a portion of the personal item.

A wearer may press a linkage part of the clasp, thereby causing the linkage to be elongated and the clasp move from the default closed position to an open position. In the open position, the wearer can insert a portion of the personal item (e.g., the hinge from a pair of eyeglasses). When the clasp is closed, it is securely closed around the inserted portion of the personal item (e.g., the hinge of the eyeglasses). As such, the personal item is kept close to the body. Additionally, the clasp may include other components, such as a ring, a hook, and/or a bail. Preferably, the bail is rotatable.

Figure 1:
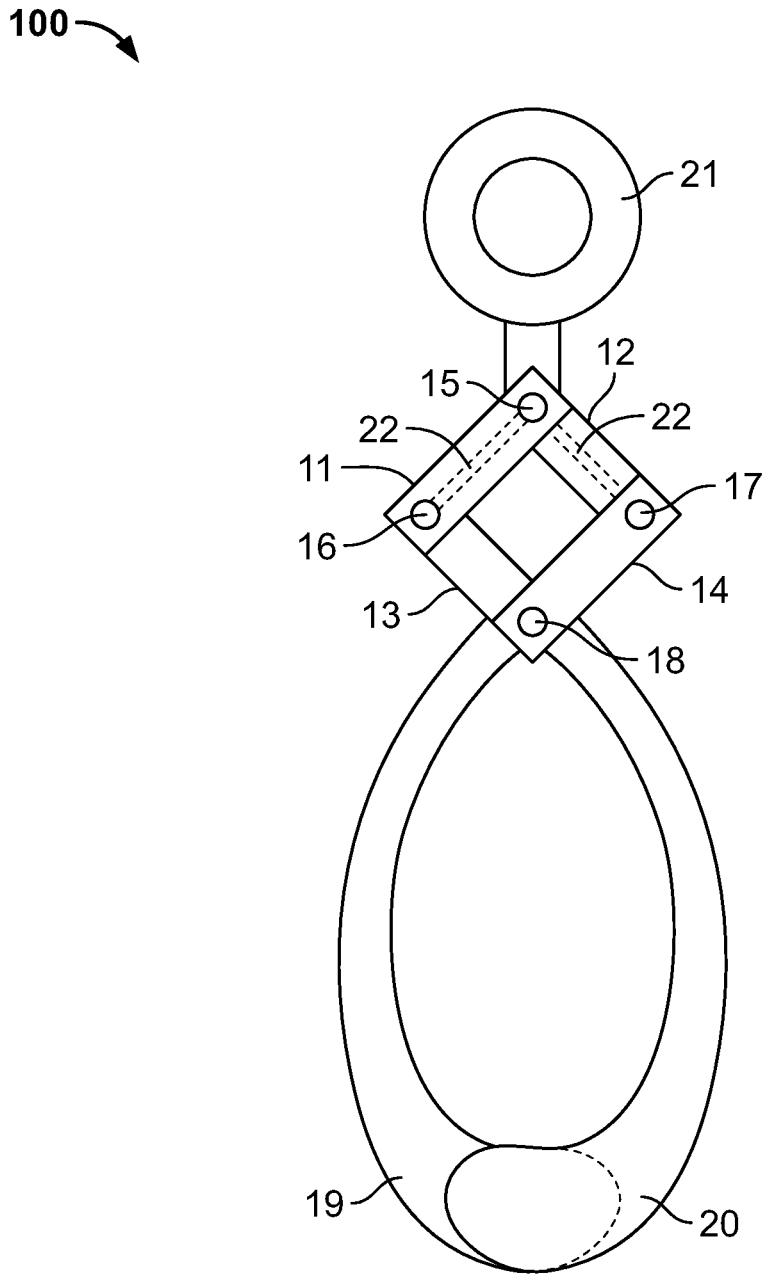
FIG. 1 shows a front view of a clasp device and system, in the default closed position, according to various embodiments of the disclosure.

FIG. 1 illustrates a clasp device and system 100 when in the default closed position, in accordance with various embodiments of the present invention. Clasp 100 includes a first member (e.g., the upper left member 11), a second member (e.g., the upper right member 12), a third member (e.g., the lower left member 13), and a fourth member (e.g., the lower right member 14). It should be appreciated that the terms upper, lower, left and right are relative terms being used for illustrative purposes in relation to one embodiment and are not intended to limit the scope of the present invention.

The upper left member 11 and the upper right member 12 are pivotally coupled to one another at the first pivoting point (e.g., the top pivoting point or pin 15). The upper left member 11 is coupled to the lower left member 13 at the second pivoting point (e.g., the left pivoting point or pin 16). The upper right member 12 is coupled to the lower right member 14 at the third pivoting point (e.g., the right pivoting point or pin 17). Additionally, the lower left and right members are coupled to one another at the fourth pivoting point (e.g., the bottom pivoting point or pin 18). Members 11-14 may thus collectively form a quadrilateral linkage In the default closed position, the upper portion (e.g., the linkage) of the clasp may have a substantially diamond shape. For instance, the closed clasp may have an upper "diamond" part, as shown in FIG. 1. The lower members 13 and 14 have respective extensions 19 and 20 that extend beyond the bottom pin 18 to collectively form a set of jaws and that are movable between a default closed position and an open position relative to each other, for respectively securing and releasing at least a portion of the personal item.

As shown in FIG. 1, the lower left member 13 has an extension (e.g., the left bottom end 19), extending from the bottom pin 18; and the lower right member 14 also has an extension (e.g., the right bottom end 20), extending from the bottom pin 18. In the default closed position, the bottom ends 19 and 20 together form a closed loop, for holding and securing a personal item. As shown in FIG. 1, the bottom ends 19 and 20 can be hook-shaped, such that the bottom of the closed clasp 100 has a generally ellipse shape (e.g., 35° angle ellipse), and the bottom ends partly overlap one another.

Preferably, the four members together form a staggered structure. For instance, as shown in FIG. 1, the upper left member 11 and the lower right member 14 are positioned over (or in front of) the upper right member 12 and the lower left member 13. Alternatively, the upper left member and the lower right member may both be positioned under (or in the back of) the upper right member and the lower left member. It should be appreciated that other configurations, including but not limited to the opposite orientation as described above, may also be possible.

In some embodiments, the upper members 11 and 12 may also include an internal spring system 22 (e.g., wire form spring or torsion spring) to bias the clasp towards the default closed position. For instance, the top pin 15 may go through the center of the internal spring. Optionally, clasp 100 may include an additional ring and/or shank structure 21, coupled to the top pin 15. Such additional structures may help attach the clasp to a necklace, chain, shirt button or the like.

The sizes of the clasp device and system, according to this invention, may be designed and adapted according the personal items to be secured. As one example, each side of the upper diamond part of clasp 100 may have a length of about 36 mm; the length between the bottom pin 18 and the bottom of the whole clasp 100 is about 85 mm; and the overlapped areas between the two bottom ends 19 and 20 has a ellipse shape with a long axis of about 24 mm. Those sizes may be varied as desired or proportionally scaled up or down.

Figure 2:
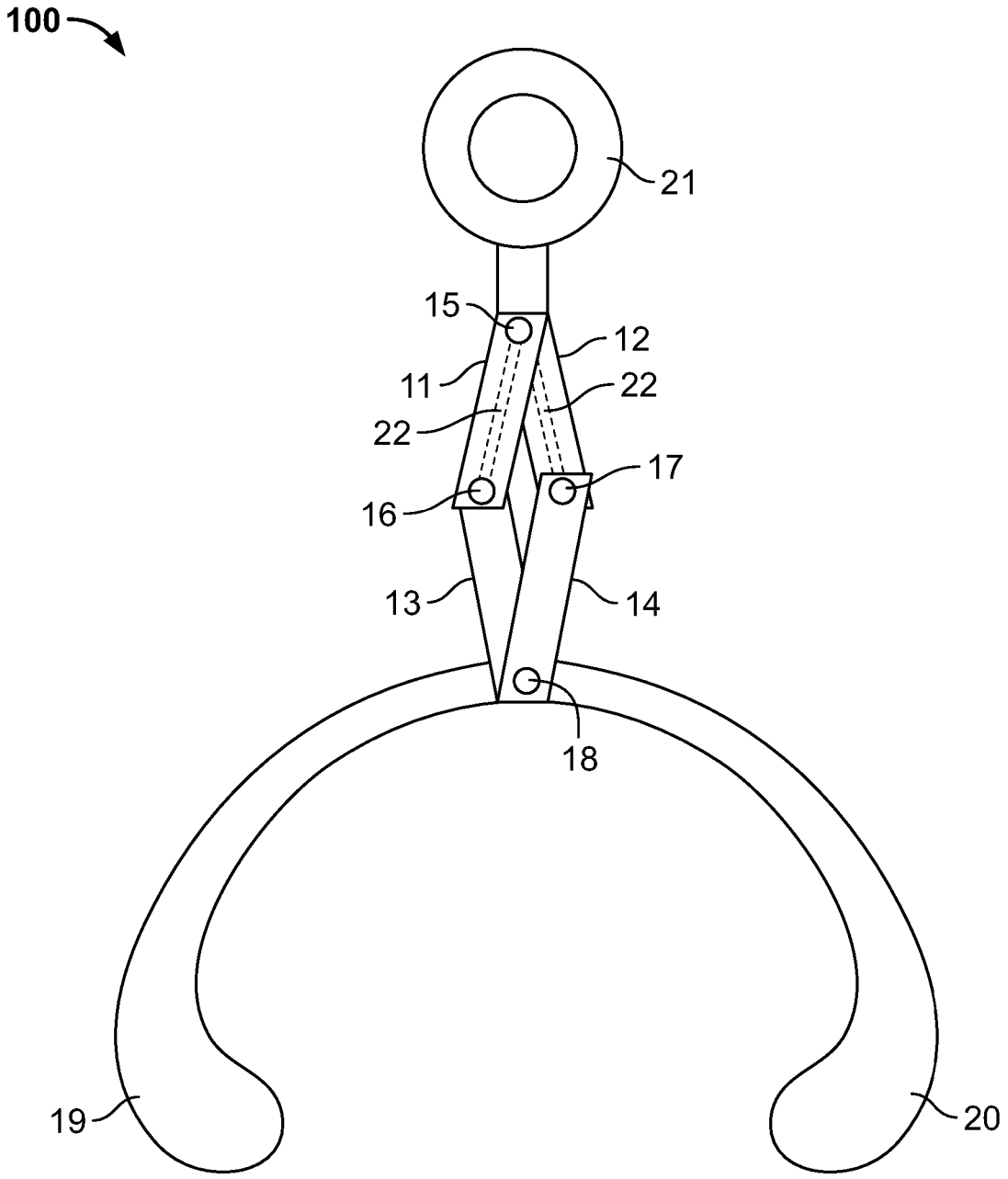
FIG. 2 shows a front view of a clasp device and system, in an open position, according to various embodiments of the disclosure.

FIG. 2 illustrates clasp 100 when in an open position. The extensions of the third and fourth members (e.g., the bottom ends 19 and 20) of clasp 100 are able to move from the default closed position to the open position responsive to inward forces being applied to areas of the linkage generally corresponding to the second and third pivoting points (e.g., the left pin 16 and the right pin 17). In other words, the open position can be achieved by a wearer pressing the upper part (e.g., the regions generally corresponding to the left and right pins in the upper "diamond" or "square" part) of the clasp. By doing so, the linkage is elongated, thereby causing the bottom ends 19 and 20 to move away from each other. Accordingly, the bottom of the clasp is opened. In the open position, the wearer can insert a portion of the item (e.g., the hinge from a pair of eyeglasses). When the clasp is closed again to its default position, it is then securely closed around the inserted portion of the item. As such, the item can be kept close to the body.

FIGS. 1-2 also illustrate a clasp having a set of jaws (e.g., a left jaw 19 and a right jaw 20) movable between an open position and a closed position about a pivoting end of the jaws (e.g., the pin 18), as well as a linkage coupled with the pivoting end of the jaws and configured to cause the jaws to move to the open position when manipulated in a first direction (as shown in FIG. 2) and to cause the jaws to move to the closed position when manipulated in a second direction (as shown in FIG. 1). The linkage may be a quadrilateral (e.g., diamond-shaped) linkage, and the jaws may form at least a portion thereof. As such, the wearer can press or compress the linkage transversely relative the jaw, to move the jaws to the open position; or press or compress the linkage longitudinally relatively to the jaws, to move the jaws to the closed position. Alternatively, the jaws may automatically return to the closed position responsive to a spring bias.

Figure 3A:
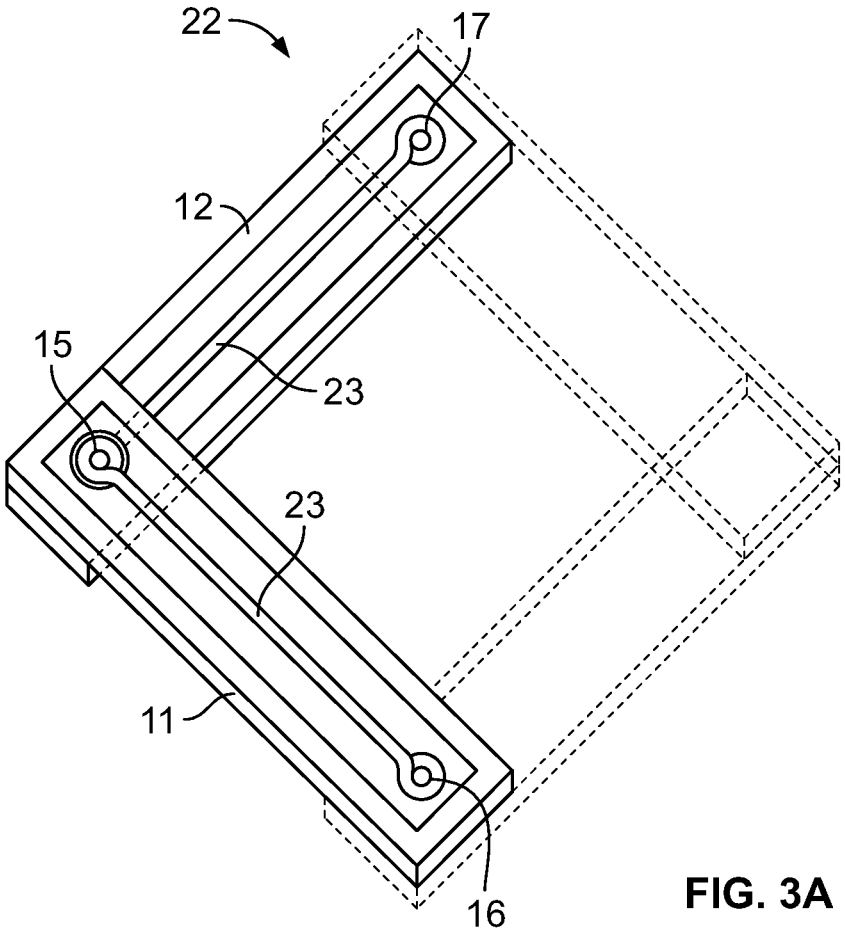
FIG. 3*a* shows a front internal perspective view of an internal spring system in a clasp device and system, according to various embodiments of the disclosure.
Figure 3B:
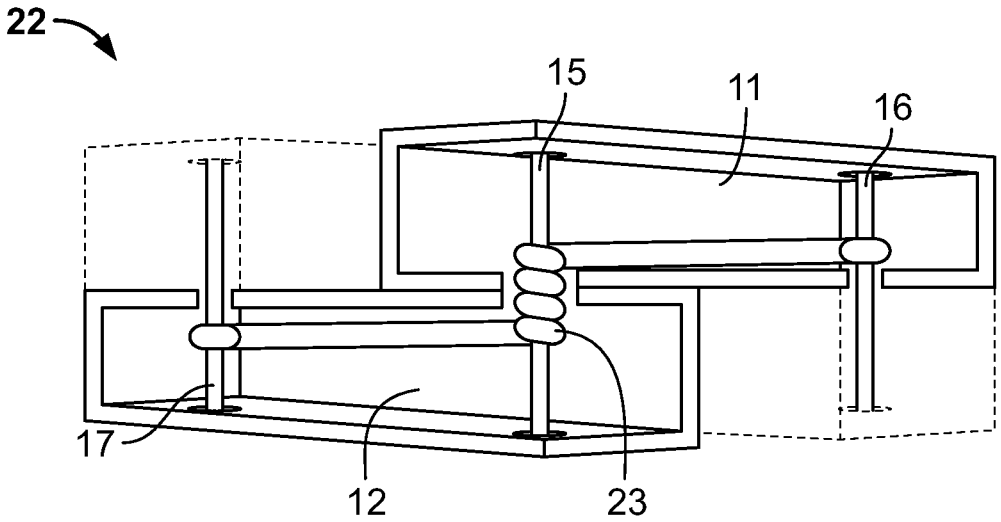
FIG. 3*b* shows a side internal perspective view of an internal spring system in a clasp device and system, according to various embodiments of the disclosure

FIGS. 3*a*-3*b* more specifically illustrate an internal spring system 22 of clasp 100, in accordance with various embodiments. As shown in FIGS. 3*a*-3*b*, upper members 11 and 12 may be hollow such that they define internal chambers, inside which an internal spring (e.g., a wire form spring) 23 engages and wraps around top pin 15. Optionally, spring 23 extends and further engages other pivoting points (e.g., the left pin 15 and the right pin 17). Alternatively, the internal spring 23 may have legs that respectively extend down portions of the lengths of upper portions 11 and 12 and abut, and apply a bias force to, interior surfaces of the outer walls thereof. As such, the internal spring system 22 is able to bias the clasp towards the default closed position.

Figure 4:
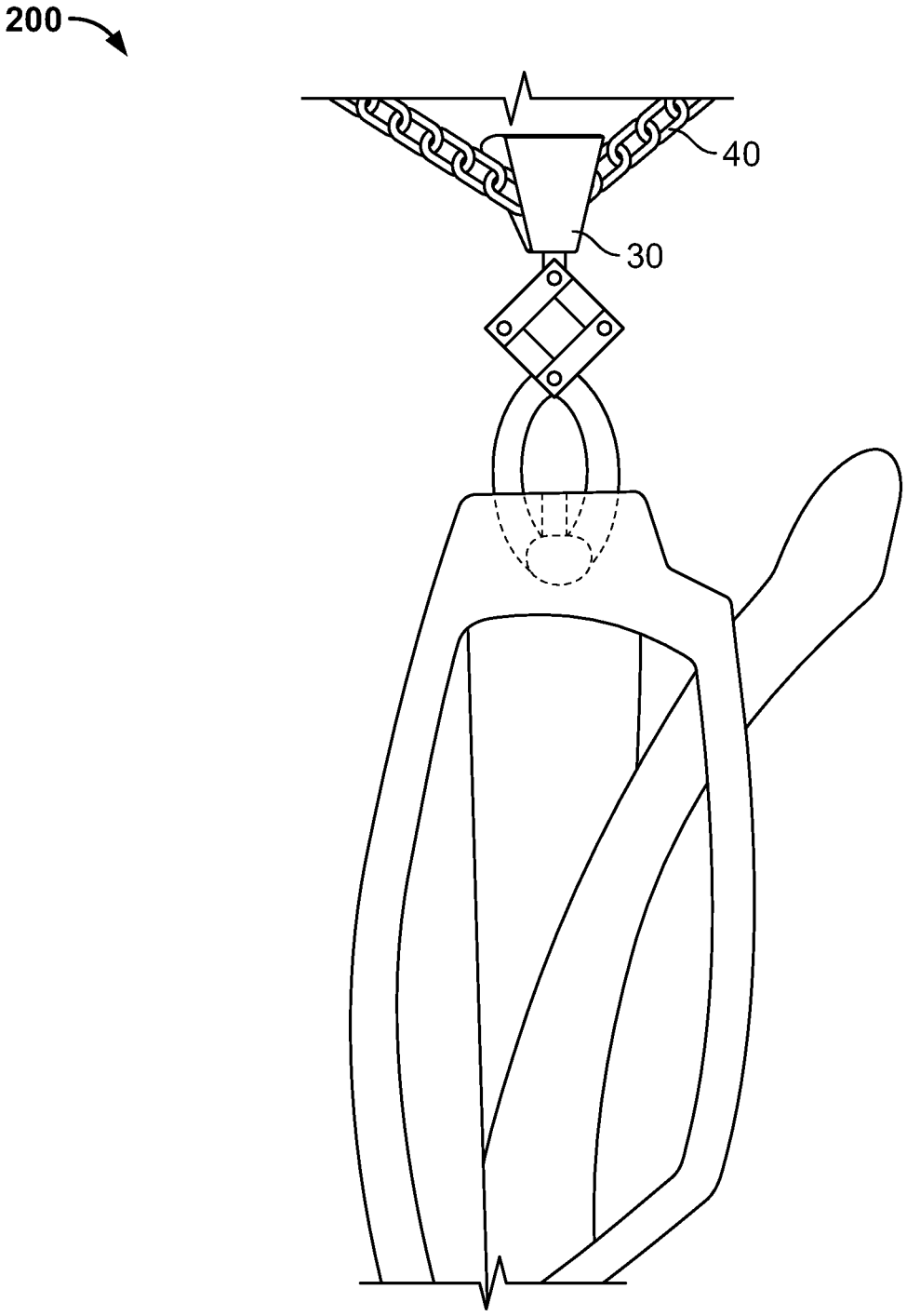
FIG. 4 shows a clasp with a bail, wherein the device and system is attached to a necklace and holds a pair of eyeglasses, according to various embodiments of the disclosure.

FIG. 4 illustrates a clasp 200 that holds and secures a pair of eyeglasses. The clasp according to various embodiments may include other components, such as a ring, a hook, and/or a bail, which may be used for improving the attachment of the clasp to a necklace or chain. For instance, the clasp may be coupled with a ring for connection with another object (e.g., insertion of a necklace or chain). Further, the clasp may be coupled with a hook or bail, in order to be more conveniently attached to, or detached from, a necklace or chain. As shown in FIG. 4, clasp 200 is further coupled to a bail 30, which in turn attaches the clasp 200 to a wearer's necklace 40. The bottom of the clasp 200 is closed around the hinge of the eyeglasses, thereby securely holding the eyeglasses. The bail 30 can be either fixed or rotatable.

In various embodiments, the clasp may include a rotatable bail, so that it would be easier for the wearer to use the clasp at different angles. As such, the bail may include a rotation system, which enables the bail (and the clasp coupled to the bail) to rotate within a desired angular range (e.g., between 0 and 360 degrees).

Figure 5A:
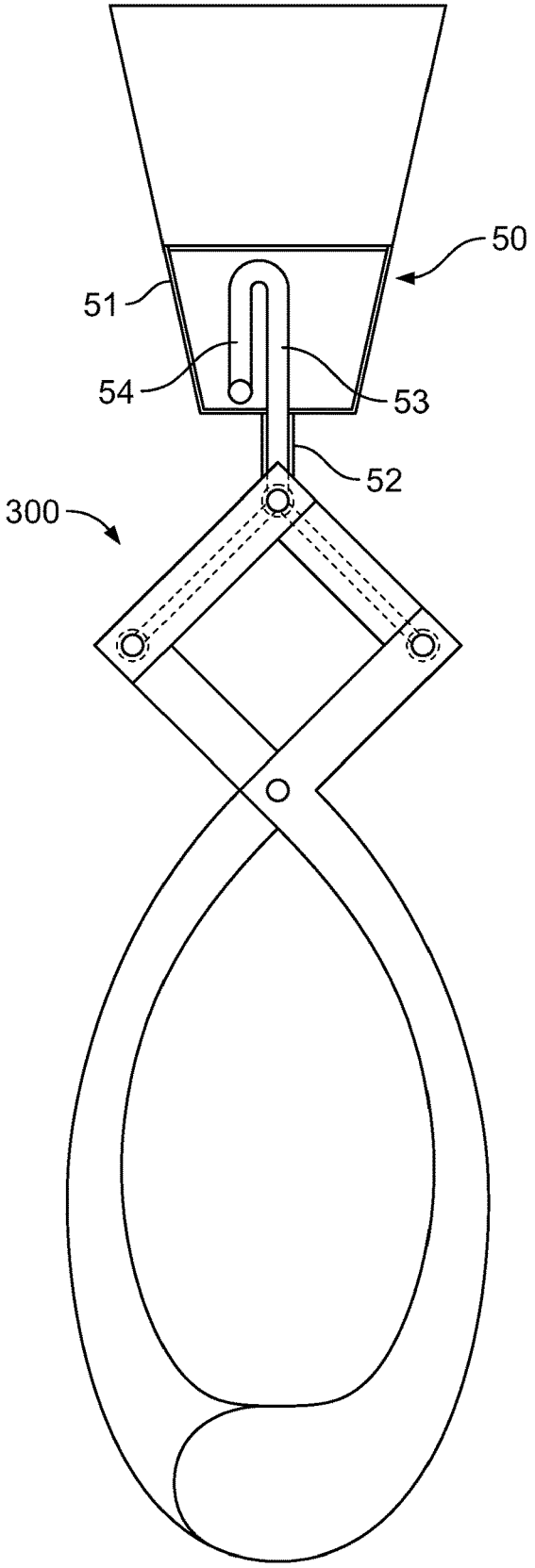
FIG. 5*a* shows a clasp with a first exemplary bail rotation system, according to various embodiments of the disclosure.
Figure 5B:
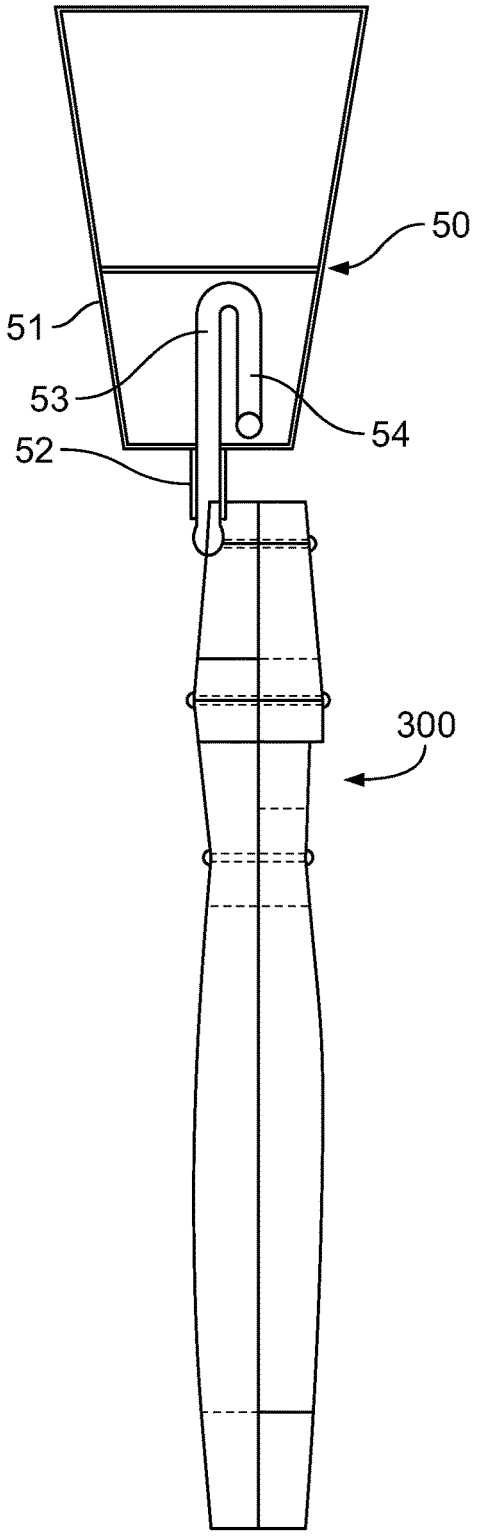
FIG. 5*b* shows a side view of a clasp with the first exemplary bail rotation system, according to various embodiments of the disclosure.

FIGS. 5*a*-5*d* illustrate a clasp with a first exemplary bail rotation system, according to various embodiments of the disclosure. As shown in FIGS. 5*a*-5*b*, clasp 300 is coupled to a rotatable bail 50. The rotation system of bail 50 includes a housing 51; a tube sheath 52; and a rotatable pin 53, which can be rotated inside the tube sheath 52 and the housing 51. The rotatable pin 53 is coupled to clasp 300 (optionally by a ring structure wrapping around the back top pin of the clasp), so that when the pin 53 rotates, clasp 300 will rotate as well. The rotatable pin 53 may include a hook-shaped or U-shaped top end 54, which can be rotated inside the housing 51.

Figure 5C:
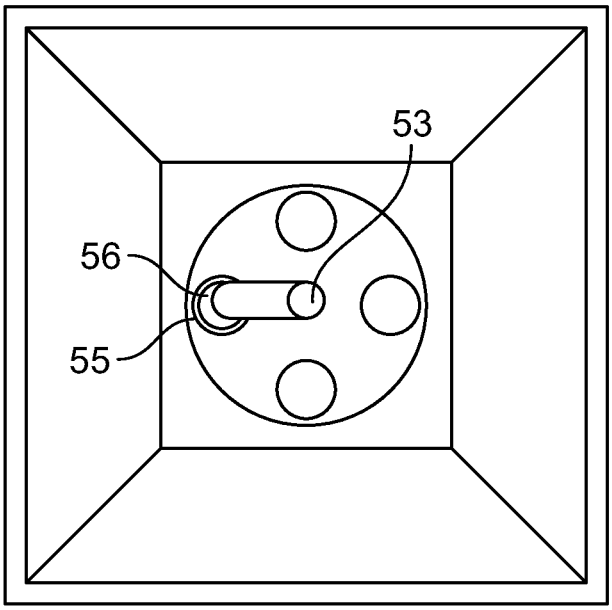
FIG. 5*c* shows a top view of the first exemplary bail rotation system, according to various embodiments of the disclosure.
Figure 5D:
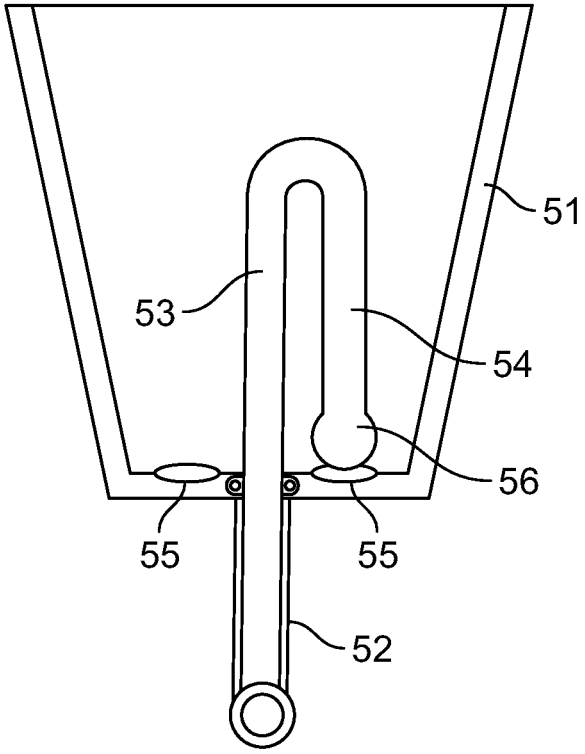
FIG. 5*d* shows a further side view of the first exemplary bail rotation system, according to various embodiments of the disclosure.

With reference to FIGS. 5*c*-5*d*, the housing 51 may include one or more recesses or dimples 55 on its inside bottom wall to enable the rotatable pin 53 to selectively seat therein. For instance, in the illustrated embodiment, the housing 51 has four dimples 55, which are spaced equal distance apart. The rotatable pin 53 may also have a ball 56 at its top end, for selectively seating in the dimples 55. As such, when the pin 53 is rotated, ball 56 selectively moves in and out of those dimples 55.

Figure 6A:
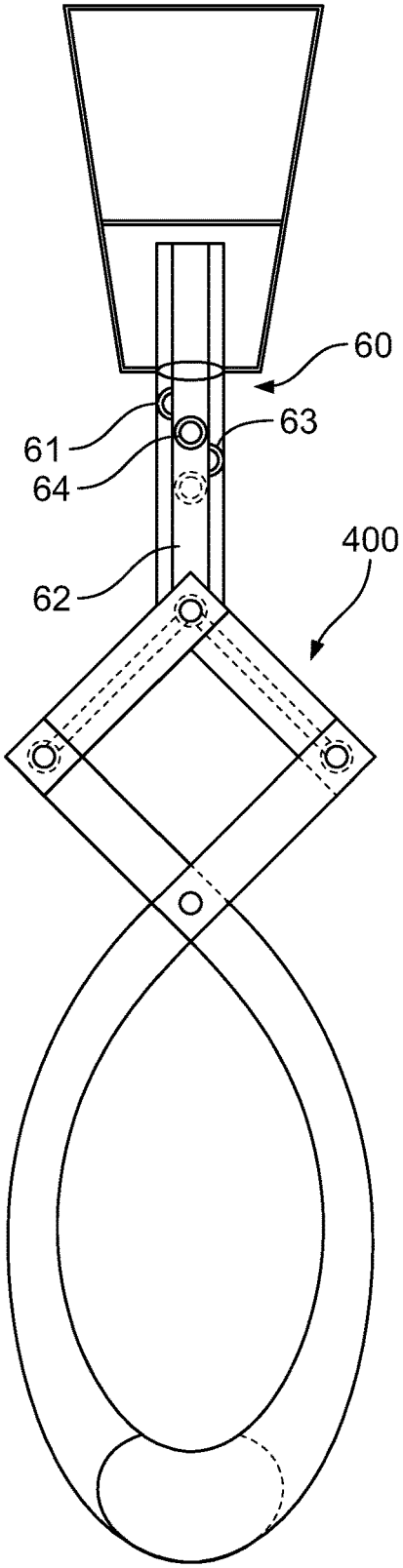
FIG. 6*a* shows a clasp with a second exemplary bail rotation system, according to various embodiments of the disclosure.
Figure 6B:
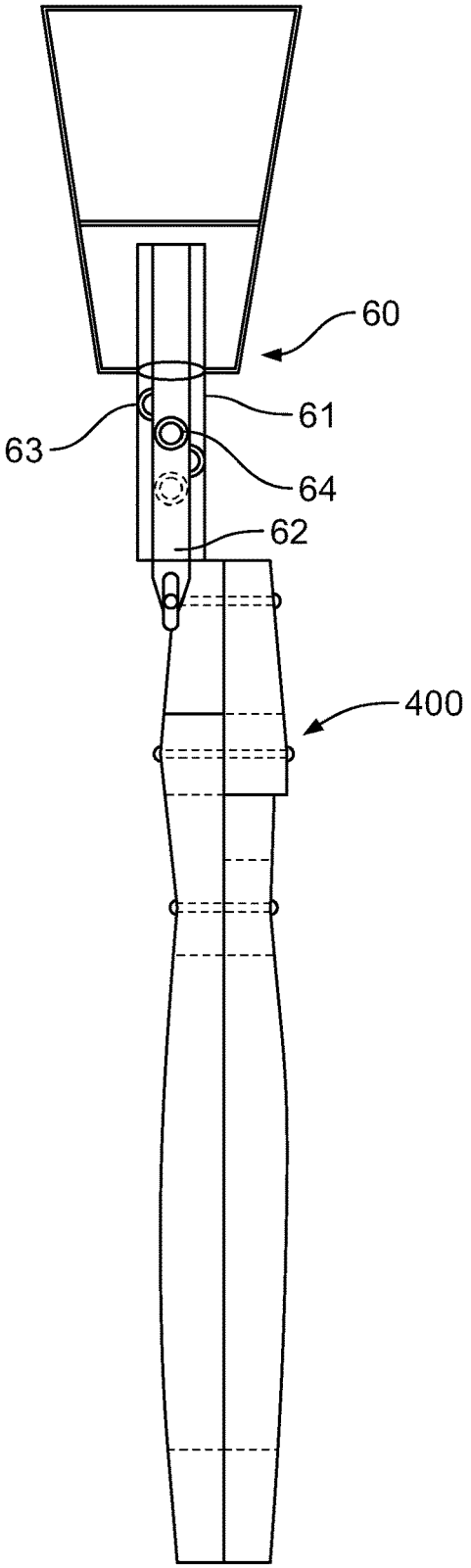
FIG. 6*b* shows a side view of a clasp with the second exemplary bail rotation system, according to various embodiments of the disclosure.
Figure 6C:
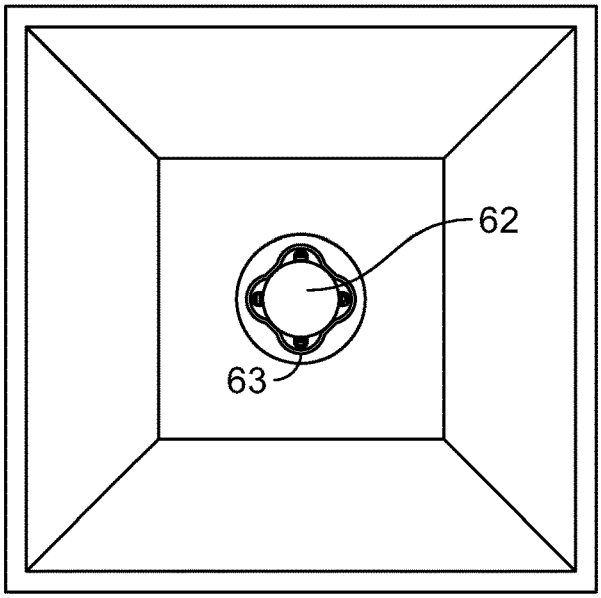
FIG. 6*c* shows a top view of the second exemplary bail rotation system, according to various embodiments of the disclosure.
Figure 6D:
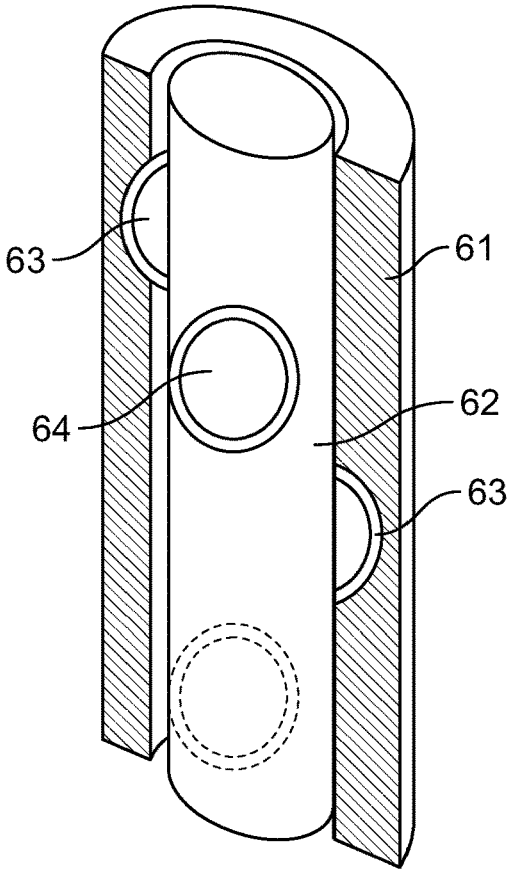
FIG. 6*d* shows a further side view of the second exemplary bail rotation system, according to various embodiments of the disclosure.

Alternatively, FIGS. 6*a*-6*d* illustrate a clasp with a second exemplary bail rotation system, according to various embodiments of the disclosure. As shown in FIGS. 6*a*-6*b*, clasp 400 is coupled to a rotatable bail 60. The rotation system of bail 60 includes a cylinder-shaped housing 61 and a rotatable pin 62 inside the housing. The rotatable pin 62 is coupled to clasp 400 (optionally by a ring structure wrapping around the back top pin of the clasp). Moreover, as shown in FIGS. 6*c*-6*d*, the housing 61 may include one or more recesses 63 on its inside wall; and the rotatable pin 62 may include one or more protrusions 64 on its side wall that correspond to the recesses 63. In various embodiments, the protrusions 64 may be radially movable relative to the pin 62. Further, the protrusions 64 may be biased away from the pin 62 by corresponding springs 63. As such, when a rotational force is applied to the pin 62, inner wall of the housing 61 counteracts the bias force of the springs 63 and forces the any protrusion 64 that was seated in a recess 63 to move radially towards the pin 62, thereby enabling rotation.

Figure 7:
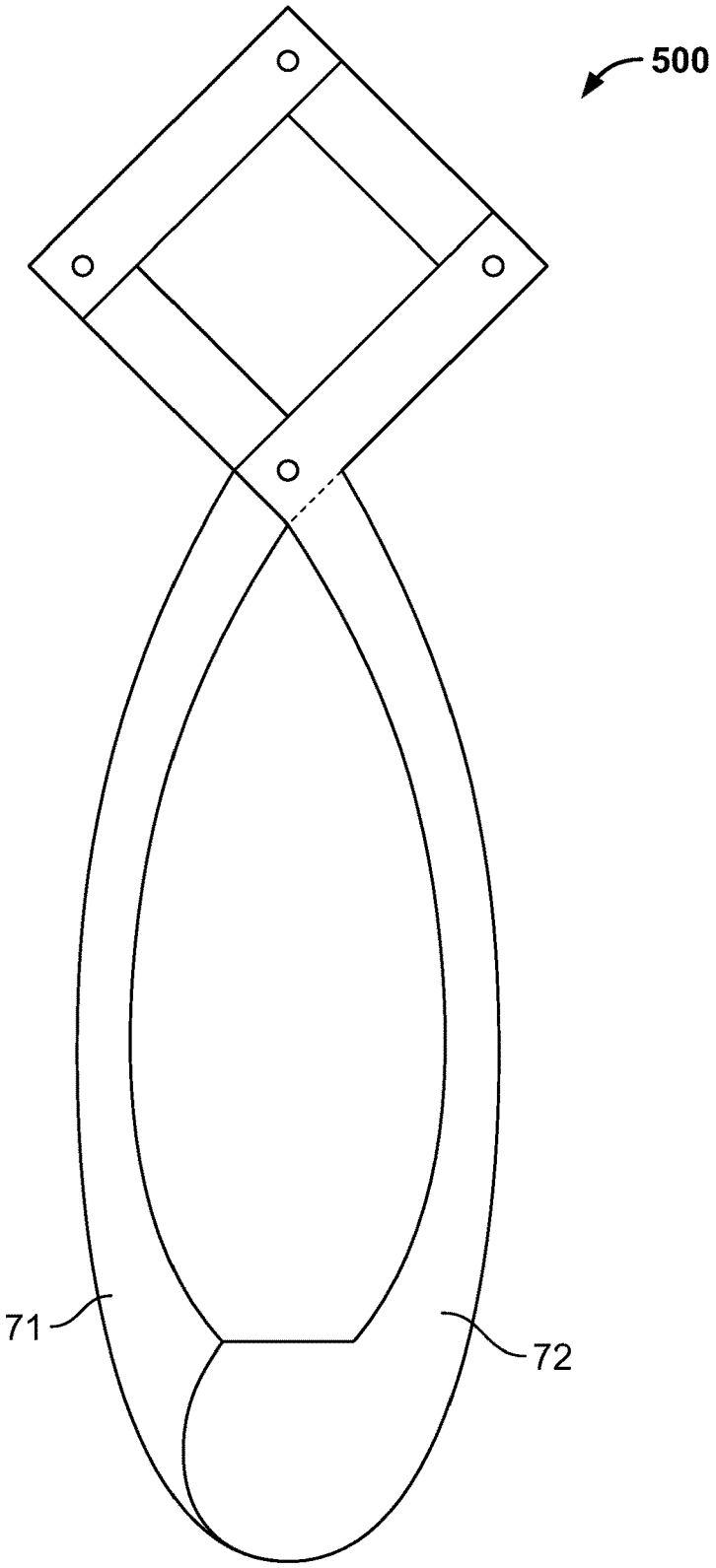
FIG. 7 shows a front view of another exemplary clasp device and system, according to various embodiments of the disclosure.

FIGS. 7-10 illustrate further examples of a clasp according to this invention. The shapes of the clasp device and system, according to this invention, may be designed and adapted according the personal items to be secured. For instance, FIG. 7 illustrates clasp 500, which has bottom ends 71 and 72. Bottom ends 71 and 72 can be hook-shaped, such that the bottom of the closed clasp 500 has a generally narrow ellipse shape than clasp 100, and the bottom ends 71 and 72 partially overlap one another.

Figure 8:
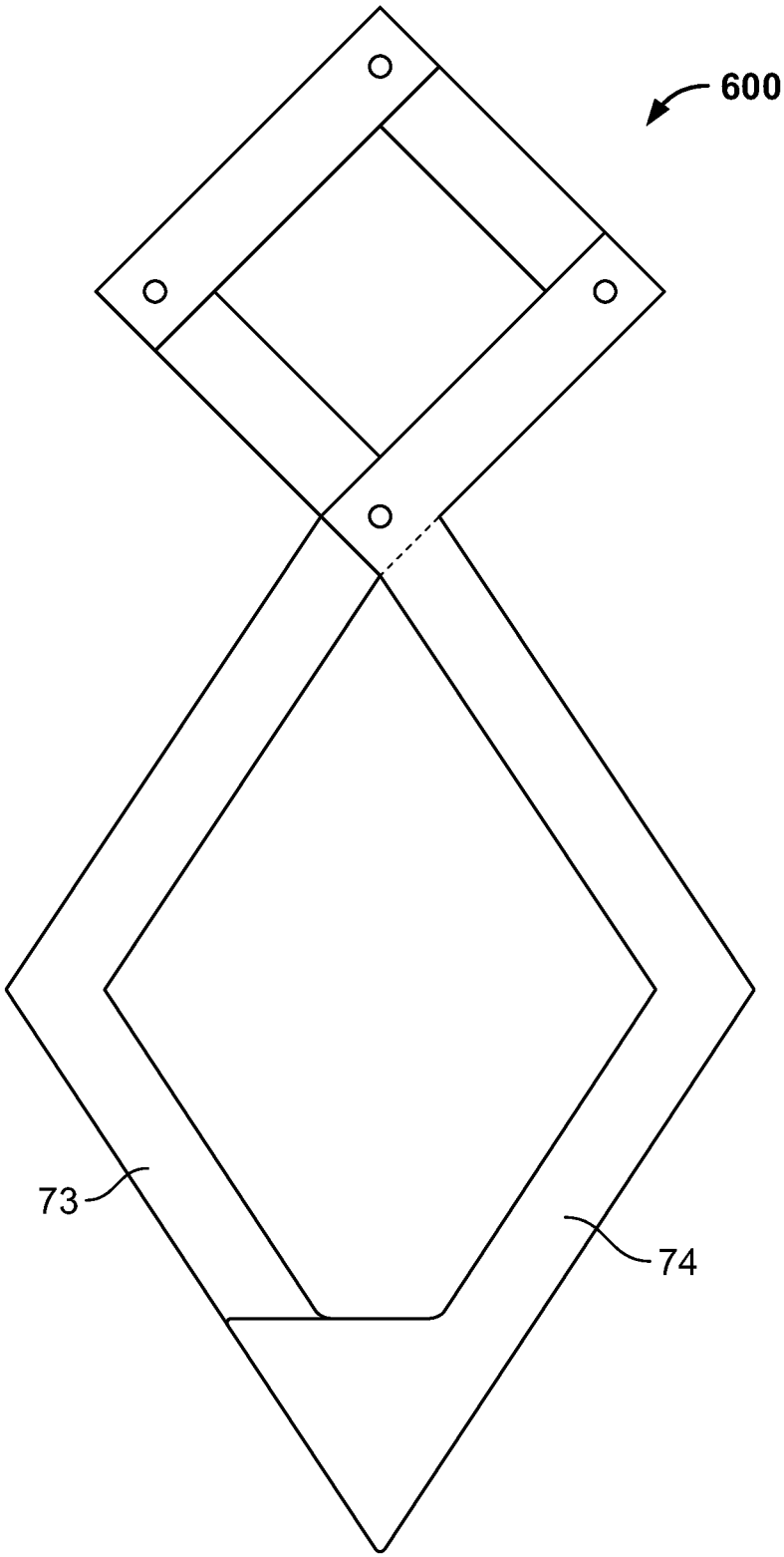
FIG. 8 shows a front view of a further exemplary clasp device and system, according to various embodiments of the disclosure.
Figure 9:
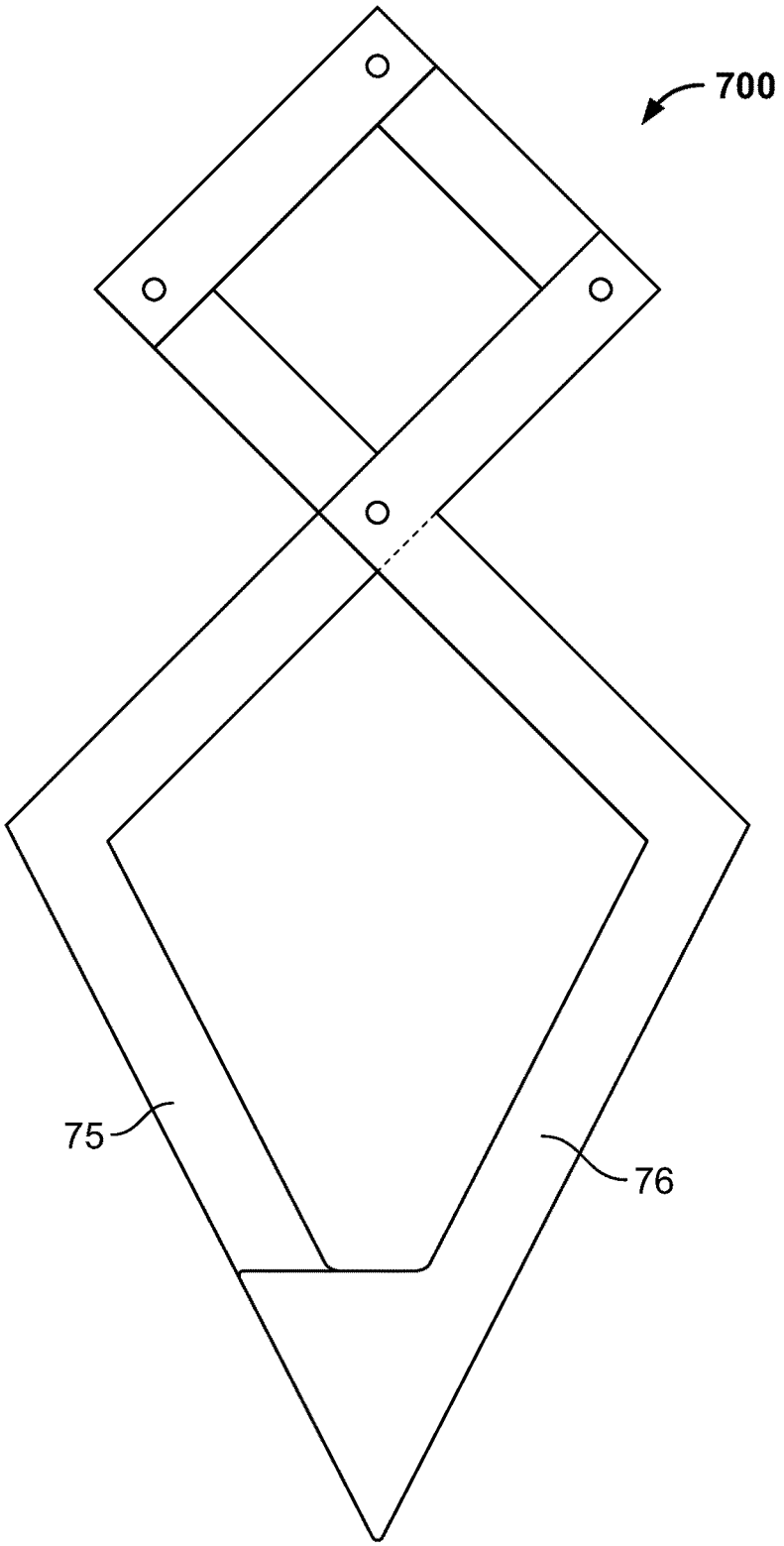
FIG. 9 shows a front view of a further exemplary clasp device and system, according to various embodiments of the disclosure.
Figure 10:
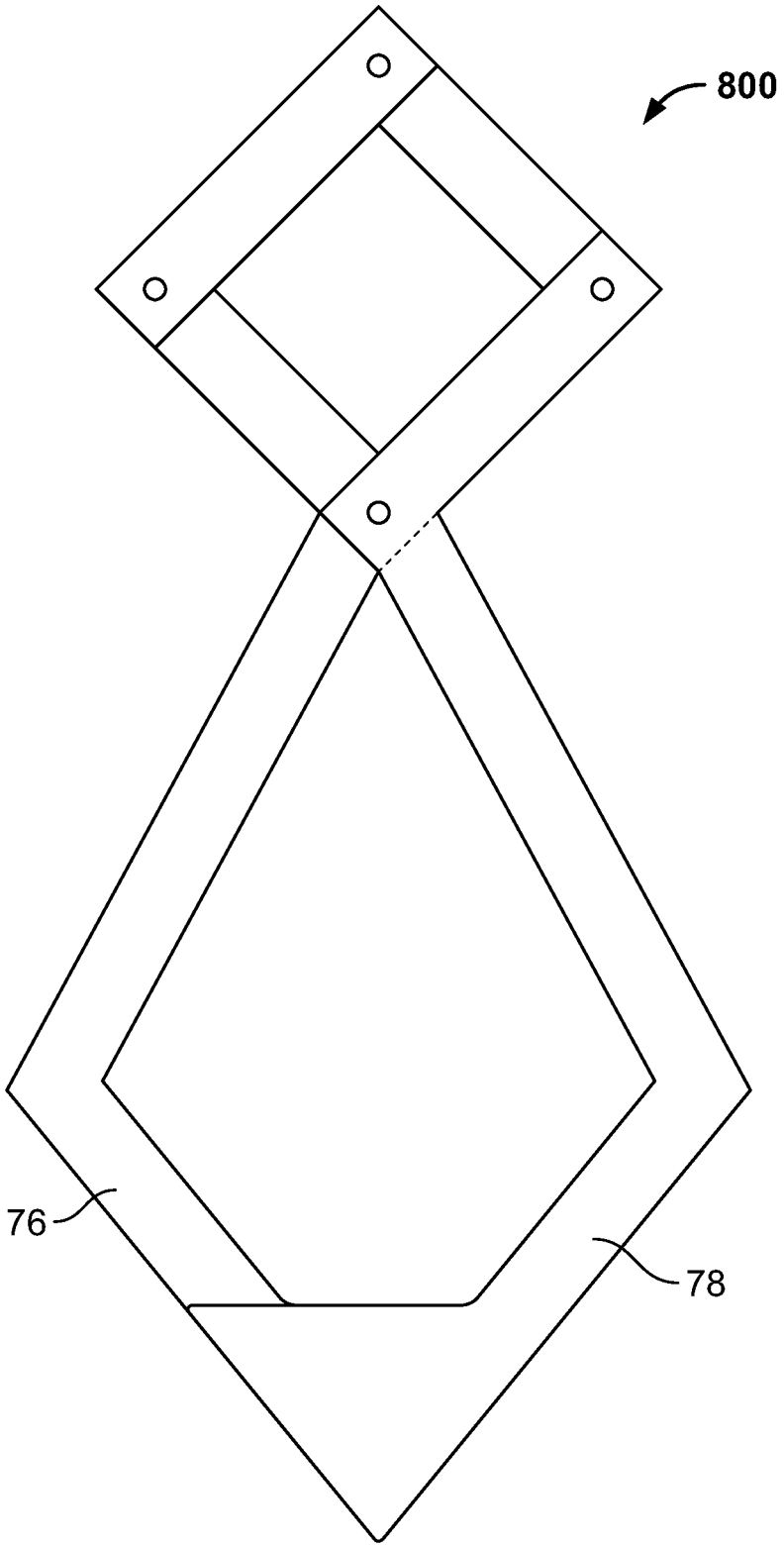
FIG. 10 shows a front view of a further exemplary clasp device and system, according to various embodiments of the disclosure.

FIGS. 8-10 illustrate clasps having a generally quadrilateral-shaped bottom, when in the default closed position. As shown in FIG. 8, the bottom of the closed clasp 600 has a generally rhombus shape, and two bottom ends 73 and 74 partly overlap one another. As shown in FIG. 9, the bottom of the closed clasp 700 has a "kite" shape, and bottom ends 75 and 76 partly overlap one another. As shown in FIG. 10, the bottom of the closed clasp 800 has a prism or inverted kite shape, and bottom end 77 and 78 partly overlap one another.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The invention claimed is:

1. A clasp for securing a personal item to a human wearer, comprising:

a first member;

a second member coupled with the first member at a first pivoting point;

a third member coupled with the first member at a second pivoting point; and a fourth member coupled with the second member at a third pivoting point and coupled with the third member at a fourth pivoting point, wherein the third and fourth members each have respective extensions that extend beyond the fourth pivoting point;

wherein the extensions of the third and fourth members are movable between a default closed position and an open position relative to each other, for respectively securing and releasing at least a portion of the personal item; and wherein the first and second members include internal springs.

2. The clasp of claim 1, wherein the extensions of the third and fourth members are configured to form a loop when in the default closed position, for securing the personal item.

3. The clasp of claim 2, wherein the loop is generally ellipse-shaped or quadrilateral-shaped.

4. The clasp of claim 2, wherein the extensions of the third and fourth members partially overlap one another when in the closed position.

5. The clasp of claim 1, wherein the first and second members and portions of the third and fourth members are arranged to form a quadrilateral linkage.

6. The clasp of claim 5, wherein the extensions of the third and fourth members move from the default closed position to the open position responsive to inward forces being applied to areas of the linkage generally corresponding to the second and third pivoting points.

7. The clasp of claim 1, wherein the clasp is attachable to a necklace or chain at an end opposite the extensions of the third and fourth members.

8. The clasp of claim 1, further comprising a ring, a hook, or a bail, coupled with the clasp at the first pivoting point.

9. The clasp of claim 1, further comprising a bail coupled with the clasp at the first pivoting point, wherein the bail is rotatable.

10. The clasp of claim 9, wherein the bail comprises:

a housing;

a tube sheath extending from a center of a bottom of the housing; and a rotatable pin disposed within the tube sheath and the housing.

11. The clasp of claim 10, wherein the bail comprises a ring coupling the rotatable pin with the first pivoting point.

12. The clasp of claim 10, wherein the housing comprises one or more recesses on an inside bottom wall of the housing, and the rotatable pin includes a hook- shaped end that is rotatable within the housing and selectively movable in and out of the recesses.

13. The clasp of claim 9, wherein the bail comprises a cylindrical housing and a rotatable pin disposed therein.

14. The clasp of claim 13, wherein the bail comprises a ring coupling the rotatable pin with the first pivoting point.

15. The clasp of claim 14, wherein an inside wall of the housing includes a recess and the rotatable pin comprises a protrusion corresponding to the recess.

16. The clasp of claim 1, wherein the extensions of the third and fourth members are movable between a default closed position and an open position relative to each other, for respectively securing and releasing at least a portion of a pair of eyeglasses, a key, or a ring.

17. A clasp for securing a personal item to a human wearer, comprising:

a set of jaws movable between an open position and a closed position about a pivoting end of the jaws, the jaws sized and shaped to securely hold the personal item when in the closed position, the personal item selected from the group consisting of a pair of eyeglasses, a key, and a ring; and a linkage coupled with the pivoting end of the jaws and configured to cause the jaws to move to the open position when manipulated in a first direction and to cause the jaws to move to the closed position when manipulated in a second direction, wherein when the jaws are in the open position, the linkage is compressed transversely relative to the jaws.

18. The clasp of claim 17, wherein when the jaws are in the closed position, the linkage is compressed longitudinally relative to the jaws.

19. A clasp for securing a personal item to a human wearer, comprising:

a set of jaws movable between an open position and a closed position about a pivoting end of the jaws, the jaws sized and shaped to securely hold the personal item when in the closed position, the personal item selected from the group consisting of a pair of eyeglasses, a key, and a ring;

the personal item; and a linkage coupled with the pivoting end of the jaws and configured to cause the jaws to move to the open position when manipulated in a first direction and to cause the jaws to move to the closed position when manipulated in a second direction, wherein the linkage comprises a quadrilateral linkage and the jaws form at least a portion thereof.

20. A clasp for securing a personal item to a human wearer, comprising:

a first member;

a second member coupled with the first member at a first pivoting point;

a third member coupled with the first member at a second pivoting point; and a fourth member coupled with the second member at a third pivoting point and coupled with the third member at a fourth pivoting point, wherein the third and fourth members each have respective extensions that extend beyond the fourth pivoting point, wherein the extensions of the third and fourth members are movable between a default closed position and an open position relative to each other, for respectively securing and releasing at least a portion of the personal item, and wherein the extensions of the third and fourth members move from the default closed position to the open position responsive to inward forces being applied to areas of the clasp generally corresponding to the second and third pivoting points.

* * * * *